US006279291B1

(12) United States Patent
Geusens et al.

(10) Patent No.: US 6,279,291 B1
(45) Date of Patent: Aug. 28, 2001

(54) METHOD OF AGEING MANUFACTURED BUILDING COMPONENTS

(75) Inventors: Jozef Geusens, Zutendaal; René Thewissen, Genk, both of (BE)

(73) Assignee: Naamloze Venootschap Ebema, Zutendaal (BE)

( * ) Notice: Subject to any disclaimer, the term of this patent is extended or adjusted under 35 U.S.C. 154(b) by 0 days.

(21) Appl. No.: 09/400,939

(22) Filed: Sep. 22, 1999

(51) Int. Cl.[7] ..... E04B 1/00; B28D 1/00
(52) U.S. Cl. ..... 52/741.1; 125/1
(58) Field of Search ..... 52/741.1, 745.19, 52/596; 125/1, 2

(56) References Cited

FOREIGN PATENT DOCUMENTS

361276 A1 1/1988 (DE) .
0 339 308 6/1994 (EP) .
0 860 258 8/1998 (EP) .

*Primary Examiner*—Peter M. Cuomo
*Assistant Examiner*—James O. Hansen
(74) *Attorney, Agent, or Firm*—Killworth, Gottman, Hagan & Schaeff LLP

(57) ABSTRACT

A method of ageing stones having top and bottom faces and side faces is disclosed. The top faces and bottom faces are defined by peripheral edges. The side faces are defined by edges extending substantially perpendicular to the peripheral edges. An array of stones are provided. The stones are maintained in the array. The stones are beat whilst being maintained in the array by subjecting the stones in the array to a vibratory movement. The stones of the array are permitted to have the freedom to move relatively to one another during the vibratory movement. The freedom of movement causes the peripheral edges of the stones to impact against one another. The vibratory movement causes distressing of the peripheral edges of the stones without breaking the side faces and edges defining the side faces of the stones.

3 Claims, 8 Drawing Sheets

METHOD OF AGEING MANUFACTURED BUILDING COMPONENTS

FIELD OF THE INVENTION

This invention relates to a method of ageing manufactured building components such as paving stones, flagstones, cobble stones, paviours, slabs, blocks, bricks, tiles and slates, that are more particularly but not exclusively made of a cementitious material such as concrete or clay. Hereinafter, such manufactured building components will be generically referred to as "stones".

BACKGROUND OF THE INVENTION

Completely cured concrete stones are not renowned for their aesthetic qualities particularly when laid as paving. Accordingly, concrete stones are more often than not subjected to secondary processing, of various kinds. One of the forms of secondary processing used in the case of concrete paving stones to enable them more readily to simulate cobble stones made of natural stone is ageing. In effect, the ageing process involves treating the stones in such a way that stone pieces of various shapes and sizes are randomly removed from their edges. The edges of the stones therefore exhibit a "broken" appearance that simulates the edges of cobble stones made of natural stone, that can be referred to as the "cobble" effect. The action of removing material from stones to simulate natural stones and to enhance their aesthetic appearance is known as "distressing".

Whilst ageing can be achieved in a number of ways, for example by shot blasting, hammering and rumbling, rumbling has been the method of choice for many years.

Rumbling involves the batch feeding of a multiplicity of stones that have been fully cured on a pallet into a large rotating drum. In this specification, "fully cured" means that the so-called green stones coming on their pallets (eg 40 to a pallet) from the moulding apparatus have been subjected initially to partial-curing in a curing chamber at a predetermined humidity and temperature and for a predetermined time and then finally to complete curing in open air of the factory yard again for a predetermined time period. The rotation of the "rumbling" drum causes the stones to impact upon one another resulting in their respective top and bottom peripheral edges being randomly distressed to achieve the cobble effect. Because of the magnitude of the impact forces that occur on the stones in the rotating drum, it is essential that the stones are fully cured because partially-cured stones would disintegrate.

Unfortunately rumbling is too random and the impact forces generated by the rotation of the drum can be unpredictable thereby causing some stones to be broken or rendered too small for commercial use of the side faces defined by the vertical edges to be broken which renders laying difficult and/or the peripheral top and bottom edges are broken so that the aesthetic effect is impaired. So, with rumbling, there is sometimes an unacceptably high level of wastage. Moreover, rumbling is expensive because of the high manufacturing, operating and maintenance costs of the rotating drum.

Other disadvantages of rumbling are that instead of a continuous process from the moulding apparatus to the yard from whence the stones can be transported to site, the stones have to be transported in the yard twice which of course increases costs. Moreover, the stones do not emerge from the drum in an orderly fashion and therefore have to be re-stacked on their pallets which interrupts the whole process again and further increases costs.

EP Patent Specification Nos. 0 339 308 and the applicants' own Belgian Patent No. 1010944A3 (EP 0 860 258 A1) overcome the problems of interrupting the continuous process which would otherwise occur from moulding apparatus to the yard by having to re-stack the fully cured aged stones on the pallets after emerging from the drum by ageing partially-cured stones.

In EP Specification No. 0 339 308, machined partially-cured concrete blocks on pallets are aged by hammering tools that have blunt or rounded-off striking surfaces which knock off the top peripheral edges of the blocks leaving the top sides of the concrete blocks smooth.

The applicants' Belgian specification is specifically directed to overcoming the disadvantages of the disruption caused by having fully to cure the concrete stones before being able to coherence rumbling and the concrete stones being presented in a disorderly fashion after emerging from the rotating rumbling drum, necessitating re-stacking on pallets. To this end, the applicants devised a method of ageing concrete stones which comprises beating an array of partially-cured stones in side-by-side and edge-to-edge abutment between two elements (preferably in the form of two plates of which at least one plate is subjected to a vibratory movement). in order to prevent the stones in the array from tilting laterally and/or sliding or rolling over each other, the beating elements are spaced apart by a distance that does not exceed twice the thickness of the stones and the stones are held in abutment in the array by the use of lateral supports or guides and end supports. Whilst the method disclosed in the applicants' Belgian specification overcomes the aforementioned disadvantages and eliminates the breakages that occur with rumbling and the costs incurred by the use of a rotating rumbling drum, the applicants have found in practice that the quality the ageing is not satisfactory, This is because there is minimal distressing of the top and bottom peripheral edges of the stones so that, in the case of paving for example, the finished stones do not simulate natural cobble stones.

Accordingly, the applicants looked at ways in which the quality of the ageing of concrete stones, ie the distressing of the top and bottom peripheral edges, could be improved whilst maintaining the advantages of the method disclosed in their Belgian patent specification and of rumbling, but without the disadvantages of applicants' earlier method and of rumbling.

SUMMARY OF THE INVENTION

To this end, the present invention resides in a method of ageing stones in which an array of stones, of which each stone has top and bottom faces and side faces in use, peripheral edges defining said top and bottom faces and edges extending substantially perpendicular to said peripheral edges and defining said side faces, is beaten by means of a vibratory movement whilst being maintained in the array to distress the said peripheral edges of the stones of the array, characterised by permitting the stones of the array to have the freedom to move relatively to one another during the vibratory movement in such manner that the said peripheral edges of the stones impact against one another and cause distressing of the said peripheral edges of the stones without breaking the side faces and edges defining the side faces.

Be causing the said peripheral edges of the stones of the array to impact against one another in this way, the quality of the ageing, ie of the distressed peripheral edges, and thus the aesthetic appearance of the stones is considerably improved and the advantages of rumbling and of beating are maintained without their respective disadvantages. In particular, because the side faces and the edges of the stones defining the side faces of the stones are not broken, or at the most remain substantially undamaged, the rectangularity of the side faces is maintained, which not only facilitates laying of the aged stones but also guards against the array of aged stones falling apart when the array is lifted from one location to another. Packaging of the array of aged stones is also made much easier because the overall shape of the array is generally rectangular and the stacking of the packaged arrays on top of one another and in side by side relationship for further curing, storage and transport is greatly facilitated.

The beating of the array of stones preferably takes place between surfaces that conveniently lie in respective oppositely facing planes in an ageing station and between which surfaces the array of stones to be aged is fed and is disposed to be subjected to the vibratory movement. Advantageously, the oppositely facing surfaces are parallel or substantially parallel.

The quality of the ageing process, ie of the distressed peripheral edges, is optimised by the relative movement between the stones of the array involving lateral tilting movements, thereby causing the said peripheral edges to impact against the two oppositely facing surfaces as well as against one another.

Thus, the said oppositely facing surfaces are disposed at a distance from each other that is such as to ensure that this lateral tilting movement takes place without destroying the integrity of the array of aged stones when the said array of aged stones is removed from the ageing station.

Such surfaces may be presented by plates, e.g. of a suitable metal, which constitute beating elements and are similar to those disclosed in FIGS. 1 to 4 of the applicants' Belgian specification. Alternatively, the beating elements that present the oppositely facing surfaces may be a series of spaced apart elongate elements such as bars, strips or the like. The use of spaced-apart elongate members can bring the advantage of enhancing the ageing effect by maximising the quality of the distressed peripheral edges by, for example, having a cross-section, such as rectangular or triangular, that presents a series of edges, such as linear edges to the array of stones. Thus, in accordance with another preferred feature of the invention, the oppositely facing surfaces may be presented by a series of edges.

In order to ensure that the array of stones is retained between the surfaces when subjected to the vibratory movement and to control the degree of distressing of the said peripheral edges, the array of stones is peripherally constrained whilst maintaining the said freedom of the individual stones to move relatively to one another.

This constrained freedom of movement is enabled by the production of spaces between the individual stones of the array and around the periphery of the array. The array of stones may be peripherally constrained by any appropriate constraining means such as two elongate members acting as guides which extend in the feed direction on opposite sides respectively of the array and by two laterally extending end supports which are movable from positions in which feed of the array into and out of the ageing station is respectively permitted and prevented.

According to a preferred feature of the present invention, the stones to be aged have upper and lower faces of two different colours respectively, thereby providing laying options of one colour and two colour top faces in use.

The array stones may be fed into the ageing station on the pallet on which the array of stones has been conveyed from the partial-curing station so that it lies beneath one of the oppositely facing surfaces with an upper surface of the pallet which supports the array of stones to be aged constituting the other of said oppositely facing surfaces. Leaving the array of stones to be aged on the pallet on which array of stones has been partially cured, not only simplifies the whole process as all that needs to be done is convey the stones into the ageing station, but also the stones of the array are already in spaced apart side by side relationship which facilitates lateral tilting movement.

One way of maintaining the spaced-part relationship of the stones of the array during feeding into the ageing station is by leaving the array of stones to be aged on the pallet and either transfering the pallet onto the lower of the two oppositely facing surfaces or omitting the lower beating element and transfering the pallet into the ageing station in the manner previously mentioned above.

Using the pallet in either of these two way saves time because the array of stones remains on the same pallet throughout partial curing, ageing and conveying to the packaging station where the aged array of stones is removed from the pallet, stacked one on top of other arrays and packaged. Then the packaged arrays of aged stones are transported to the yard to be stored and complete curing. So, transferring the array of stones from the pallet for ageing and back to the pallet after ageing is avoided and, when the lower beating element is omitted, machinery costs are reduced because the pallet becomes one of the beating elements.

However, the invention also comprehends feeding the array of stones to be aged from the pallet and into the ageing station between the oppositely facing surfaces, in which case the spaced-apart relationship that exists between the stones of the array on the pallet, would normally collapse (see FIG. 1 of the applicants' Belgian specification) when the array is fed into the ageing station.

Therefore, in accordance with another aspect of the invention, and in another way of maintaining the spaced apart relationship of the stones of the array to be aged whilst the array of stones is fed from the pallet upon which the array of stones to be aged is conveyed to the ageing station, means, such as a grid, is inserted into the spaces before feeding, which means is removed from the spaces between the stones of the array before the oppositely facing surfaces are subjected to vibratory movement.

In another alternative method, that surface which is the lower of the oppositely facing surfaces may be presented by a support element as a plate which receives the array of stones from the pallet and which is itself movable into and out of a location in which it lies opposite to that surface which is the upper of the two oppositely facing upper surfaces.

If it is desired to control the ageing effect of the bottom edges in use of the stones further to facilitate laying in certain instances, e.g. of paving stones or of building blocks, one of the oppositely facing surfaces may be present by an impact absorbing material such as wood or plastics which has a minimal effect on ageing the stones.

The vibratory movement may be imparted to the upper, lower or both beating elements as described with reference to and as shown in FIG. 3 of the applicants' Belgian specification. Furthermore, the means for generating this vibratory movement may be as described with reference to, and as shown in, FIGS. 8 and 9 of the applicants' specification, the subject matter of which is hereby incorporated into this specification by reference. As the means for generating the vibratory movement is known and does not form part of the present invention, no further explanation of the way in which the vibratory movement is generated need be made.

BRIEF DESCRIPTION OF THE DRAWINGS

In order that the invention may be more fully understood, reference will now be made, by way of example, to the accompanying drawings, in which.

DETAILED DESCRIPTION OF PREFERRED EMBODIMENTS

Figure 1:
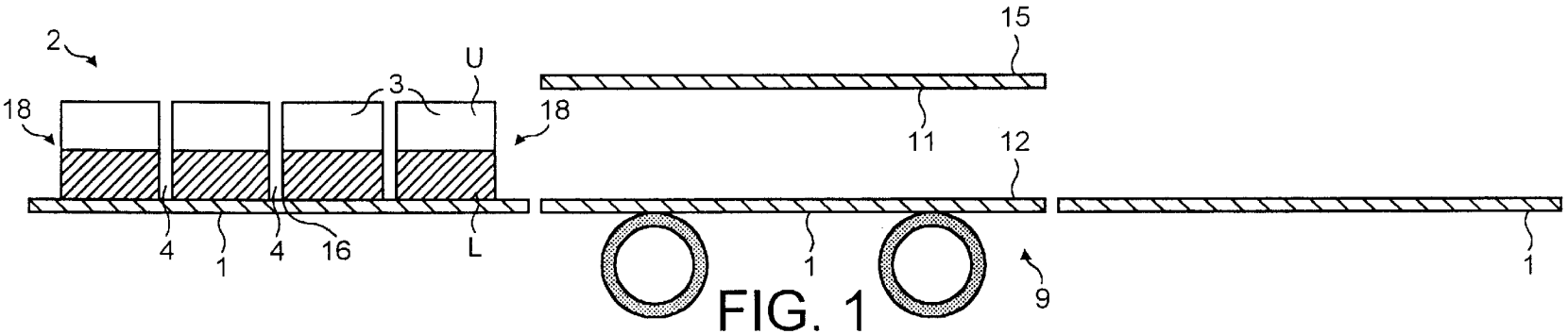
FIG. 1 is a diagrammatic side view of an ageing station, with parts removed for the sake of clarity, showing the arrival of a pallet supporting an array of partially-cured stones to be aged to be fed into the ageing station in accordance with one way of carrying out the method according to the invention.
Figure 3:
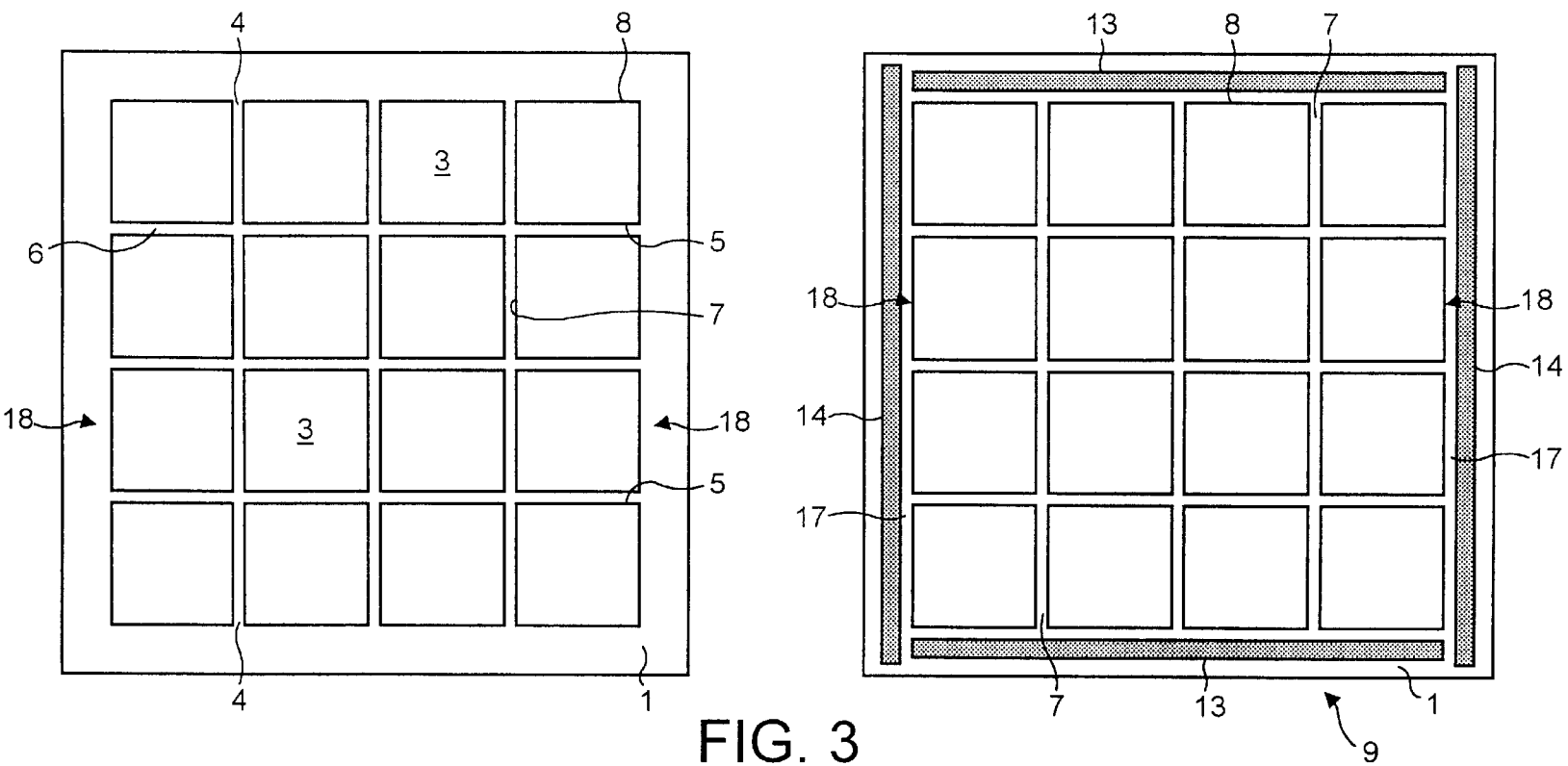
FIG. 3 is a top plan view of FIG. 2 or of FIG. 10, with parts removed for the sake of clarity.

Referring to FIGS. 1 and 3, there is shown a pallet 1 supporting an array 2 of partially-cured concrete paving stones 3 that are positioned in spaced-apart relationship, leaving spaces 4 between their end side faces 7 and spaces 6 between their lateral side faces 5. The array 2 of stones 3 has been moulded from a cementitious mixture in a conventional moulding machine (not shown) and transferred to the pallet 1 which is conveyed to a partial-curing station (not shown) and thence after partial curing to a station 9 where the stones are aged. FIG. 1 shows the pallet 1 carrying the array 2 arriving at the ageing station 9. The stones 3 are made of cementious mixtures of two colours which give rise to different coloured layers U and L which present top and bottom faces of different colours and either of which can be the top face of bottom face in use when the stones 3 are laid.

Figure 7:
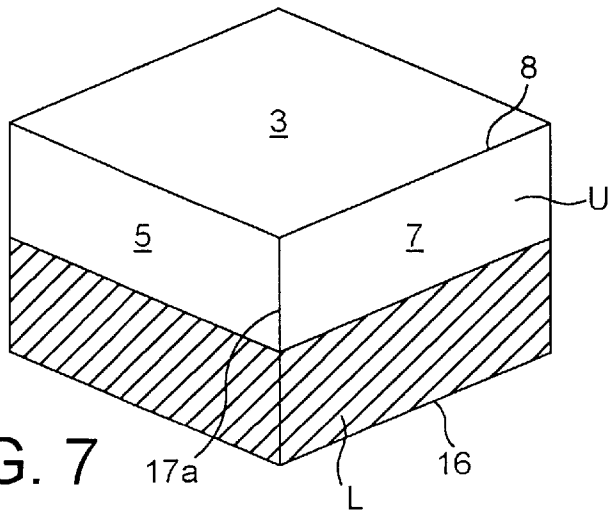
FIG. 7 is a perspective view of a single stone to be aged of any of the arrays to be aged in FIGS. 1 to 6 and 9 to 13.
Figure 9:
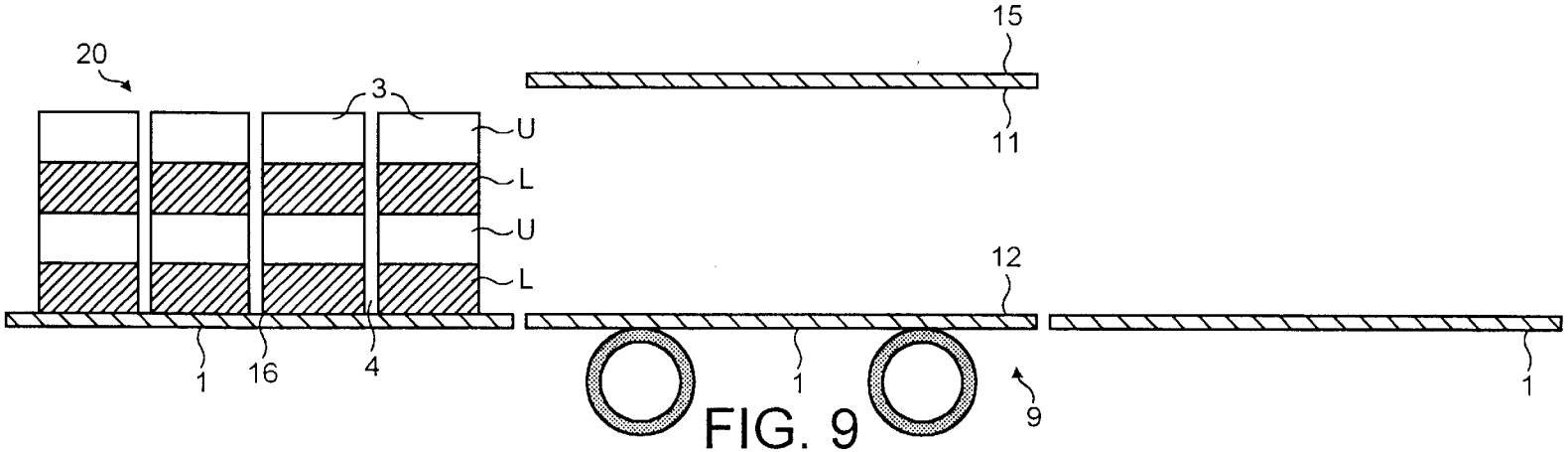
FIGS. 9, 10, 11, 11*a,* 12 and 13 are diagrammatic side views corresponding to FIGS. 1, 2, 4, 4*a,* 5 and 6 of a modification in which two arrays of stones disposed one on top of the other.
Figure 10:
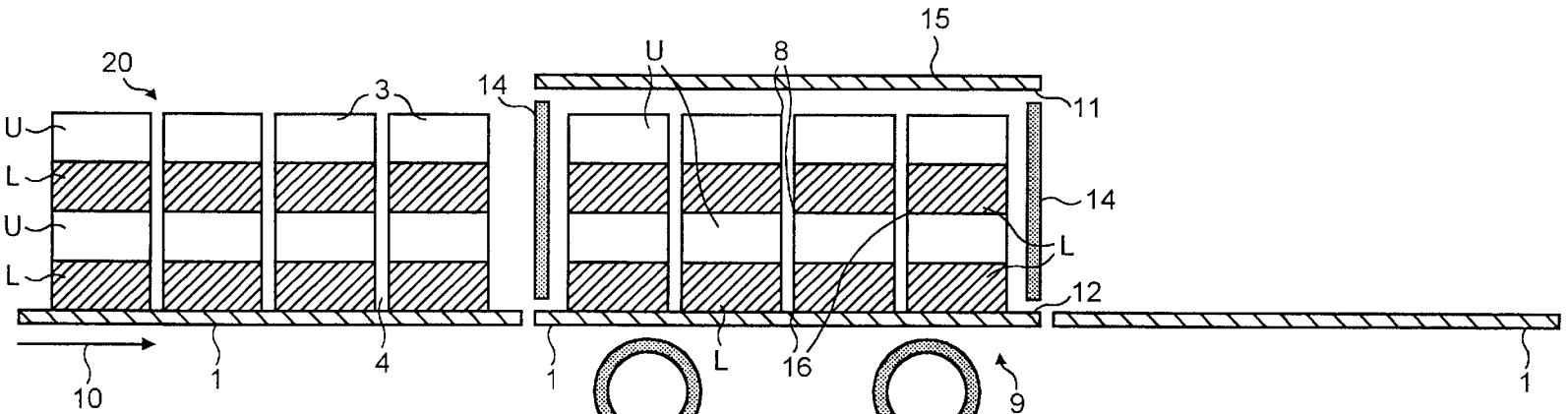
Figure 11:
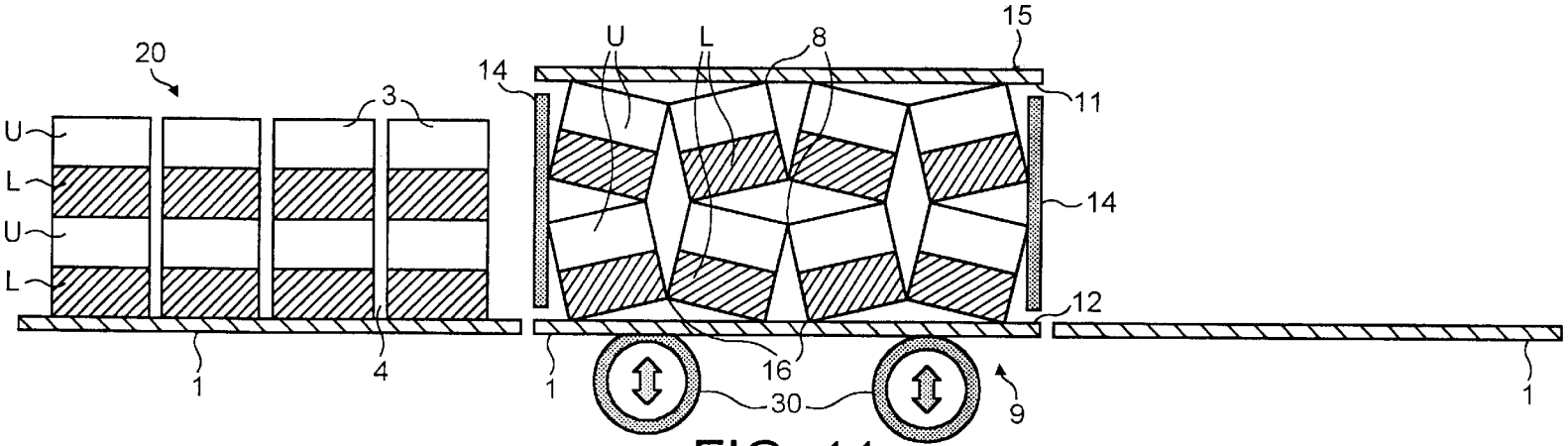
Figure 11A:
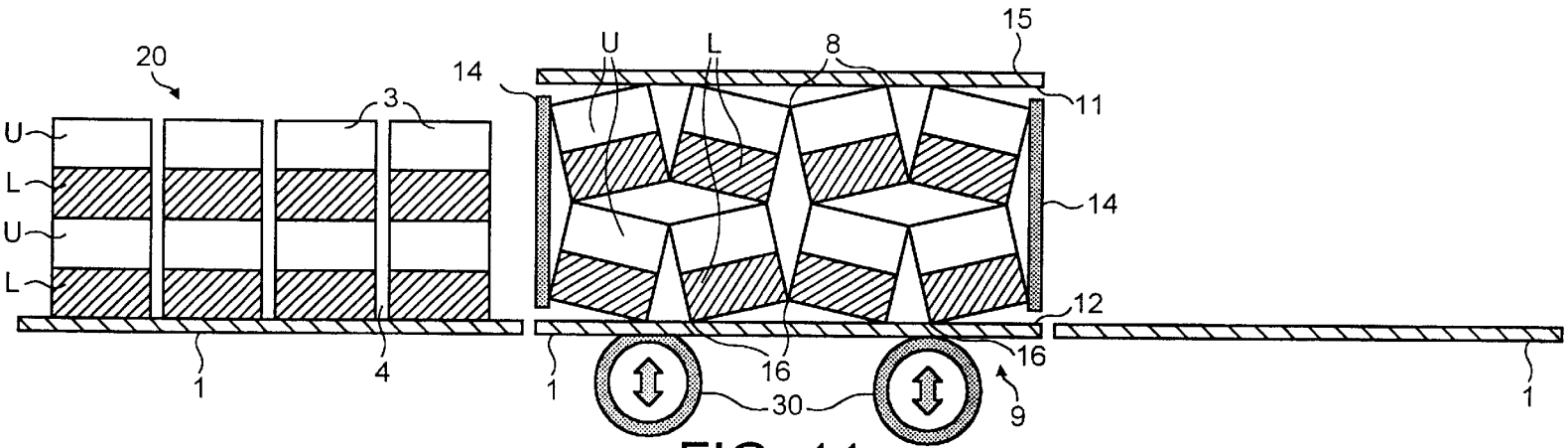
Figure 12:
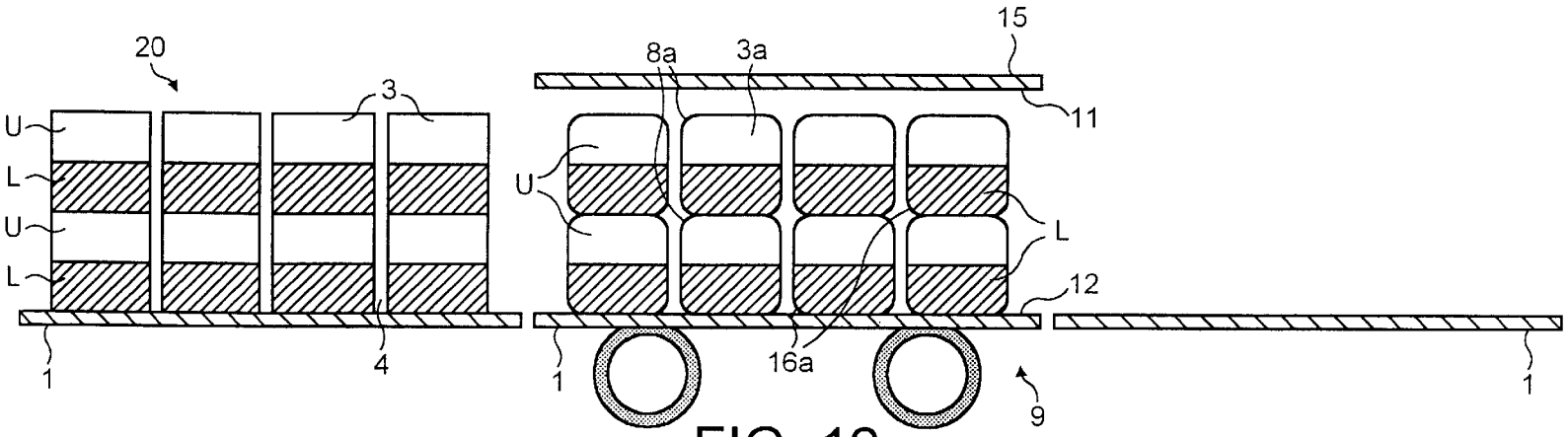
Figure 13:
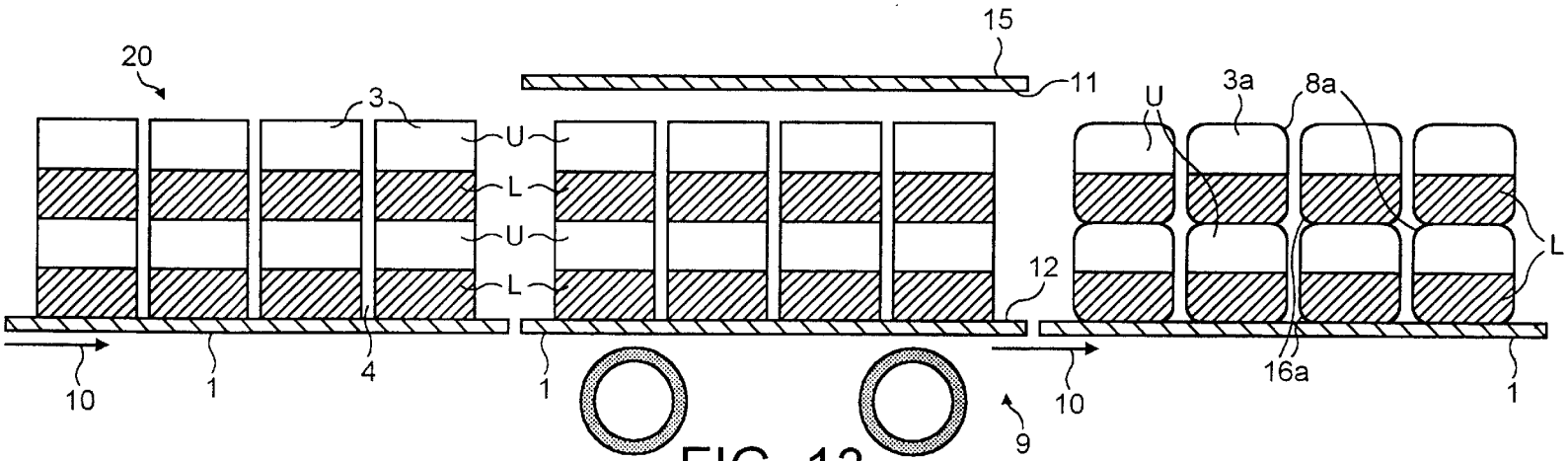

Each stone has a top face and a bottom face (not visible) in use which are defined by top and bottom (in use) peripheral edges 8 and 16 respectively (FIG. 7) and the side faces 5 and 7 are defined by side edges 17 (FIG. 7) extending substantially perpendicular to said peripheral edges 8 and 16.

Figure 2:
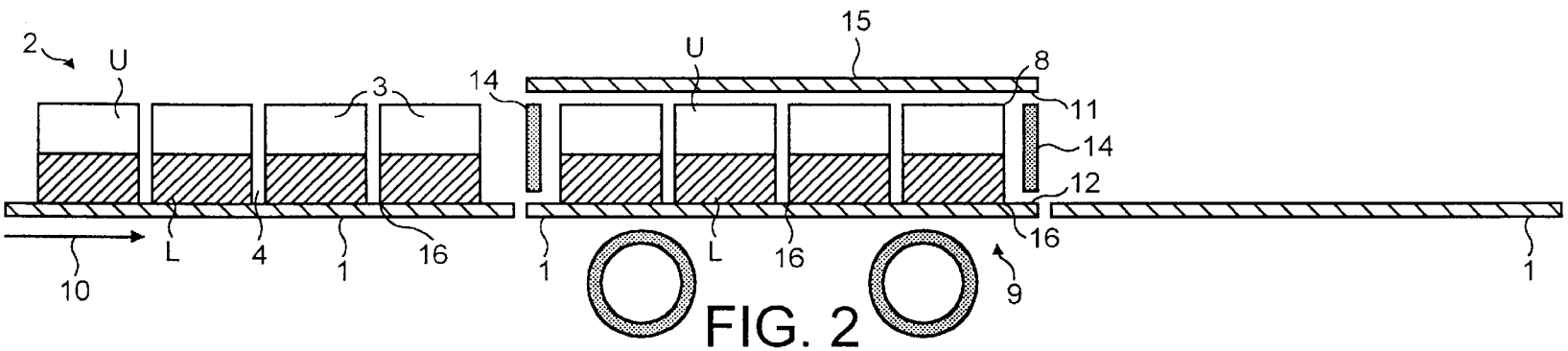
FIG. 2 is a diagrammatic side view of the ageing station of FIG. 1 showing the array of stones on the pallet in the ageing station, with another pallet supporting an array of partially cured stones to be aged having arrived at the ageing station.

As will be apparent from FIG. 2, the array 2 of stones 3 to be aged remains on the pallet 1 and is fed on the pallet 1 in the direction of the left-hand as illustrated arrow 10 as by a conveyor (not shown) and into the ageing station 9. In the ageing station 9, the array 2 of stones on the pallet 1 lies between oppositely facing upper and lower surfaces 11 and 12.

As the pallet 1 with the array 2 of FIG. 1 is fed into the ageing station 9 in FIG. 2, another pallet 1 with an array of stones 3 to be aged arrives at the ageing station 9.

The oppositely facing upper and lower surfaces 11 and 12, which lie in respective generally horizontal and parallel planes, are presented by a metal plate 15 constituting one beating element 15 and the array supporting surface 12 of the pallet 1 constituting the other beating element 1 respectively.

Between the surfaces 11 and 12, the array 2 is peripherally constrained by constraining means constituted by two elongate members extending in the feed direction indicated by the arrow 10 and acting as lateral constraints 13 (FIG. 3) forming guides and by elongate supports acting as end constraints 14 (FIGS. 2, 3, 4 and 4*a*). The end constraints 14 are movable into the illustrated position shown in FIGS. 2, 3, 4 and 4*a* and out of the FIGS. 2, 3, 4 and 4*a* position, as by pressure-fluid operated means such as double-acting piston and cylinder devices (not shown). The positions occupied by the end constraints 14 are such that spaces 17 (FIG. 3) are left between them and the respective opposite ends 18 of the array 2.

Figure 4:
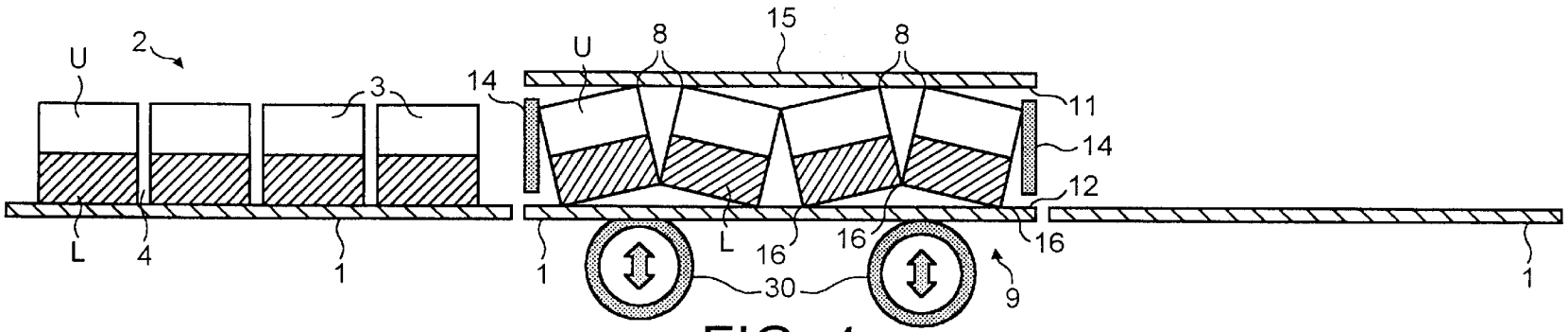
FIGS. 4 and 4*a* are diagrammatic side views of the ageing station as shown in FIGS. 2 and 3 but showing respective effects of vibratory movement, frozen in time, on the stones of the array during an ageing process.
Figure 4A:
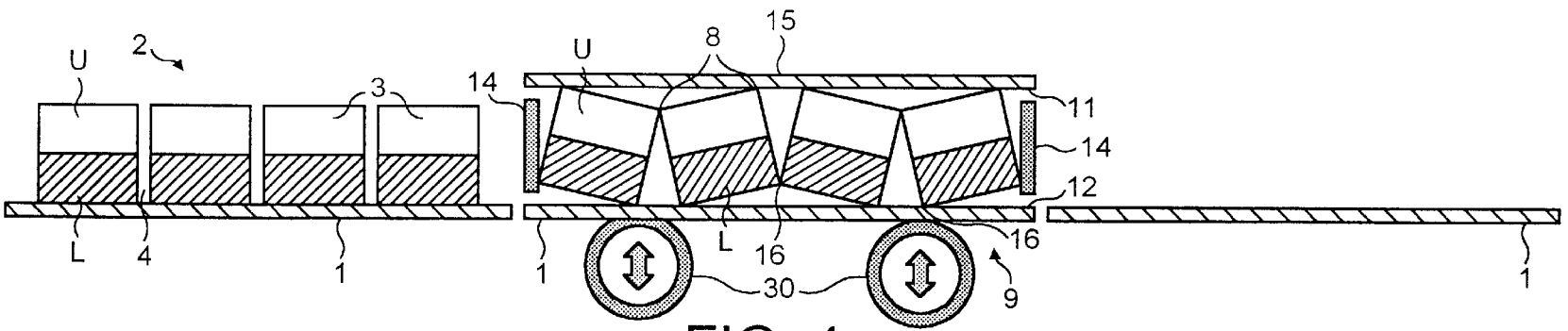

The distance between the surfaces 11 and 12 of the plate 15 and pallet 1 respectively, is adjusted by moving the plate 15 up or down, e.g. by pressure-fluid operated means such as double-acting piston and cylinder devices, in dependence upon the thickness of the stones 3. It is this distance in combination with the spaces 4 between the end side faces 7, spaces 6 between the lateral side faces 5 of the stones 3 of the array 2 and the spaces 17 between the end sides 18 of the array 2 and end constraints 14 that dictates the degree of relative lateral tilting movement of the stones 3 of the array 2 when at least one of the beating elements 15 and 1 is subjected to vibratory movement by vibration means 30 (FIGS. 4 and 4*a*).

The ageing process is commenced by subjecting the spaced apart stones 3 of the array 2 to a beating action generated by the vibratory movement of the plate 15, the pallet 1 or both the pallet and plate 15 together. This vibratory movement causes relative tilting movements of the stones 3 which are shown, frozen in time, in FIGS. 4 and 4*a*. These relative tilting movements cause the peripheral edges 8 and 16 of the stones 3 to impact against one another, against the oppositely facing surfaces 11 and 12 and against the end constraints 14, thereby causing distressing of the peripheral edges 8 and 16 of the stones 3. After an ageing process which can vary in time according to the kind of stones and the type of cementitious mix (e.g. dry or wet), which time would be readily deduced, or known, by those of ordinary skill in the art, stones 3*a* shown in FIGS. 5, 6 and 8 of the array 2*a* (FIG. 6) have distressed peripheral edges 8*a* and 16*a*.

Figure 5:
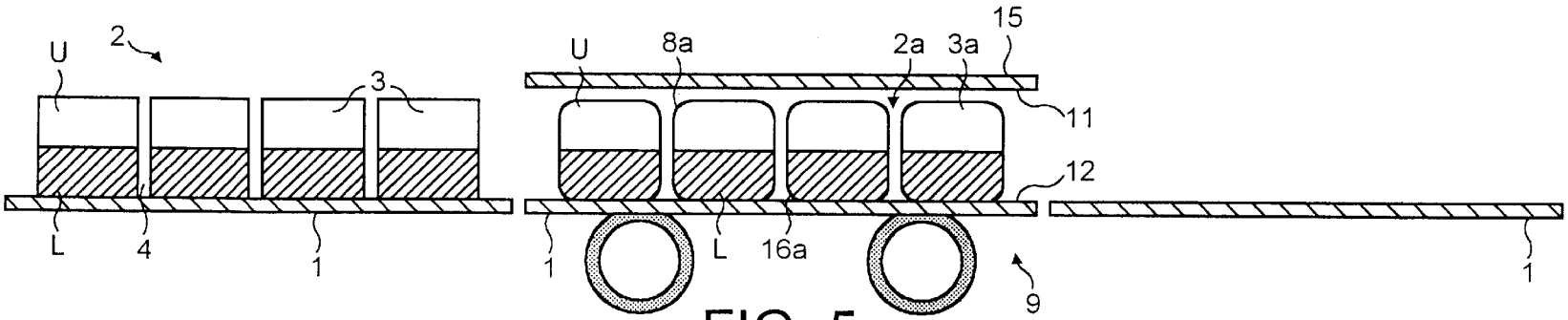
FIG. 5 is a diagrammatic side view of the ageing station as shown in FIGS. 2 and 3 but showing an array of stones which has been aged in the manner shown in FIGS. 4 and 4*a;*
Figure 6:
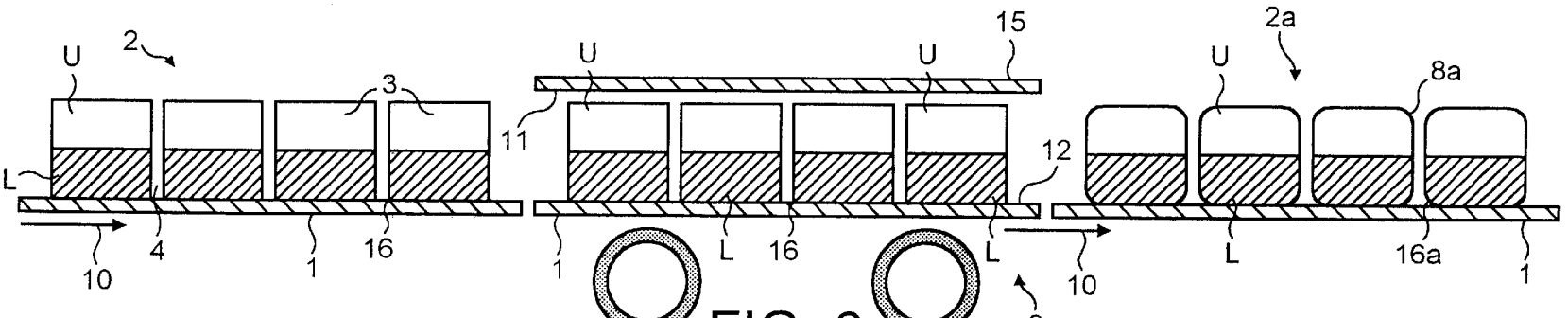
FIG. 6 is a diagrammatic side view of the ageing station of FIG. 1 but showing the array of stones which was aged in FIG. 5, removed from the ageing station, the array of stones to be aged shown in the arrival position in FIGS. 2 to 5 having been fed into the ageing station and a newly arrived array of stones to be aged at the ageing station.

The end constraints 14 are then lifted up out of the way, as will be appreciated from FIG. 5, leaving the way clear to the array 2*a* of the aged stones 3*a* shown in FIG. 6 to be conveyed into the position shown in FIG. 6, from whence the pallet 1 supported on a moving conveyor (not shown) is conveyed to a packaging station and packaged arrays of aged stones are thence transported to the yard to complete curing. As the aged array 2*a* leaves the ageing station 9, the array of stones that has arrived at the ageing station in FIG. 5 is conveyed into the ageing station in FIG. 6 whilst another array 2 of stones 3 arrives at the ageing station in FIG. 6

Figure 8:
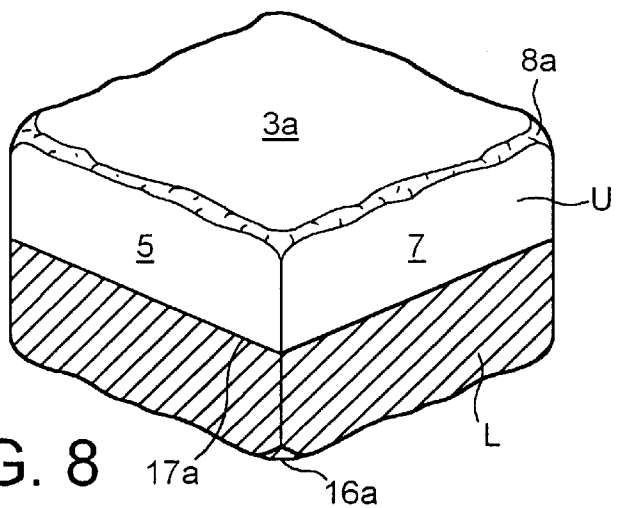
FIG. 8 is a diagrammatic perspective view of the stone of FIG. 7 which has been aged in accordance with FIGS. 4 and 4*a* or FIGS. 11 and 11*a;*

It will be appreciated from FIG. 8 that the distressing of the peripheral edges 8*a* and 16*a* has not broken or otherwise damaged the side faces 5 and 7 and vertical edges 17 defining the side faces 5 and 7. Thus the rectangularity of the side faces is maintained to facilitate laying of the aged stones and lifting of the array.

The modification of FIGS. 9, 10, 11, 11*a,* 12 and 13 differs from FIGS. 1, 2, 4, 4*a,* 5 and 6 only in that the array of stones is constituted by an array 20 formed of two single layer arrays of stones 3 stacked one upon the other. Other than the reference character 20, like parts in the Figures are given like reference characters.

It should be appreciated that various modification of ageing methods described herein may be made whilst still falling within the scope of the appended claims. For example, instead of being made of concrete, the stones may be made of clay or any other suitable cementitious material.

What is claimed is:

1. A method of ageing stones having top and bottom faces and side faces, peripheral edges defining said top and bottom faces and edges extending substantially perpendicular to the peripheral edges and defining said side faces, said method including:

a) providing an array of stones;

b) maintaining the stones in the array;

c) beating the stones whilst being maintained in the array by subjecting the stones in the array to a vibratory movement between two oppositely facing surfaces in an ageing station;

d) permitting the stones of the array to have the freedom to move relative to one another during the vibratory movement;

e) said relative freedom of movement involving lateral tilting movements between the stones of the array, thereby causing the said peripheral edges to impact against the two oppositely facing surfaces as well as against one another, whereby said vibratory movement causes distressing of the said peripheral edges of the stones without breaking the side faces and edges defining the side faces of the stones; and f) with the said oppositely facing surfaces of the stones being disposed at such a distance from each other that the lateral tilting movements do not destroy the integrity of the array of aged stones when the aged array of stones is removed from the aging station.

2. A method as claimed in claim 1, characterised in that the array is peripherally constrained with there being provision for relative movement between the stones of the array and the peripheral constraint to control the degree of distressing of the said peripheral edges.

3. A method as claim in claim 1, characterised in that the array of stones is fed into the ageing station on a pallet and in that an upper surface of the pallet which supports the array constitutes one of said oppositely facing surfaces.

* * * * *